US008701535B2

(12) United States Patent
Endo et al.

(10) Patent No.: US 8,701,535 B2
(45) Date of Patent: Apr. 22, 2014

(54) AUTOMATIC CARD-CUTTING APPARATUS

(75) Inventors: Toshimasa Endo, Tokyo (JP); Tomoki Takada, Yao (JP); Kazuya Monno, Yao (JP)

(73) Assignees: Uchida Yoko Co., Ltd., Tokyo (JP); Sakura Seiki Co., Ltd., Yao-shi (JP)

( * ) Notice: Subject to any disclaimer, the term of this patent is extended or adjusted under 35 U.S.C. 154(b) by 154 days.

(21) Appl. No.: 13/358,860

(22) Filed: Jan. 26, 2012

(65) Prior Publication Data

US 2013/0192439 A1 Aug. 1, 2013

(51) Int. Cl.

| | |
|---|---|
| ***B26D 1/01*** | (2006.01) |
| ***B65H 35/00*** | (2006.01) |
| ***B26D 7/06*** | (2006.01) |
| ***B26D 1/12*** | (2006.01) |
| ***B26D 5/08*** | (2006.01) |

(52) U.S. Cl.
USPC ..... 83/425.2

(58) Field of Classification Search
USPC ..... 83/425.2, 425, 564, 676, 504, 505, 83/508.3, 700, 498, 499, 508.2, 425.4, 83/649; 493/56, 60, 228, 229, 230
See application file for complete search history.

(56) References Cited

U.S. PATENT DOCUMENTS

| | | | | | |
|---|---|---|---|---|---|
| 391,750 | A | * | 10/1888 | Koegel | 83/169 |
| 2,747,664 | A | * | 5/1956 | Corson | 83/408 |
| 2,936,664 | A | * | 5/1960 | Myers | 83/487 |
| 3,173,326 | A | * | 3/1965 | Gulliksen et al. | 83/501 |
| 3,944,150 | A | * | 3/1976 | Jennerjahn | 242/525.7 |
| 4,077,291 | A | * | 3/1978 | Obenshain | 83/499 |
| 4,643,058 | A | * | 2/1987 | Zingler et al. | 83/23 |
| 5,397,106 | A | * | 3/1995 | Hill | 270/58.34 |
| 5,628,864 | A | * | 5/1997 | Kataigi et al. | 156/441.5 |
| 5,690,012 | A | * | 11/1997 | Blandin et al. | 83/507 |
| 2003/0217628 | A1 | * | 11/2003 | Michalski | 83/425 |

FOREIGN PATENT DOCUMENTS

| | | | | |
|---|---|---|---|---|
| JP | 53135083 | A * | 11/1978 | B26D 5/02 |
| JP | 2011-201646 | A1 | 10/2011 | |

* cited by examiner

*Primary Examiner* — Ghassem Alie
(74) *Attorney, Agent, or Firm* — Kratz, Quintos & Hanson, LLP

(57) ABSTRACT

An automatic card-cutting apparatus provided with plural transfer rollers to transfer paper, plural slitter heads to cut the paper in a transferring direction, and a lateral cutter portion to cut the paper in a lateral direction at right angles with the transferring direction to conduct divisional cutting of the paper into plural cards. Each of the plural slitter heads is provided with a side head disposed as to be freely position-adjusted in the lateral direction to cut a side edge portion of the paper into belt shape, and a middle head having an upper blade of disc and a pair of lower blades each of which contacts each of left and right side edge portions of the upper blade, disposed as to be freely position-adjusted in the lateral direction to cut a longitudinal middle waste portion of the paper into belt shape.

6 Claims, 9 Drawing Sheets

2
1A
1B
90
91
92
93
95
96
97
C
W
S
X
Y

AUTOMATIC CARD-CUTTING APPARATUS

FIELD OF THE INVENTION

This invention relates to an automatic card-cutting apparatus.

DESCRIPTION OF THE RELATED ART

A conventional automatic card-cutting apparatus is provided with a pair of upper and lower rotation piece blades to cut paper in a transferring direction, and a lateral cutter portion to cut the paper in a lateral direction at right angles with the transferring direction (refer to Japanese Provisional Publication No. 2011-201646, for example).

For example, in the conventional apparatus, plural slitter heads 9 each of which has a lower piece blade 99 as shown with two-dot broken lines in FIG. 9 are provided.

And, each of the plural slitter heads 9 is provided with a first head 9A to cut outside edges 92*a* on the left and right sides of a longitudinal middle waste portion 92 and a second head 92*b* to cut inside edges 92*b* on the left and right sides of the longitudinal middle waste portion 92 as to remove the longitudinal middle waste portion 92 of paper 90 shown with two-dot broken lines, and the first head 9A and the second head 9B are disposed on different positions on a transferring direction X.

Therefore, the number of the slitter heads 9 is large, and the entire apparatus is made long in the transferring direction X and large.

And, it is necessary to determine positions of the first head 9A and the second head 9B in a lateral direction Y rightly with high accuracy to cut the longitudinal middle waste portion 92 with a predetermined width dimension W. However, it is quite difficult to determine the positions of the first head 9A and the second head 9B in the lateral direction Y with high accuracy.

Therefore, it is an object of the present invention to provide an automatic card-cutting apparatus, having compact dimension along the transferring direction, with which the longitudinal middle waste portion can be easily cut into belt-shaped with high accuracy.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
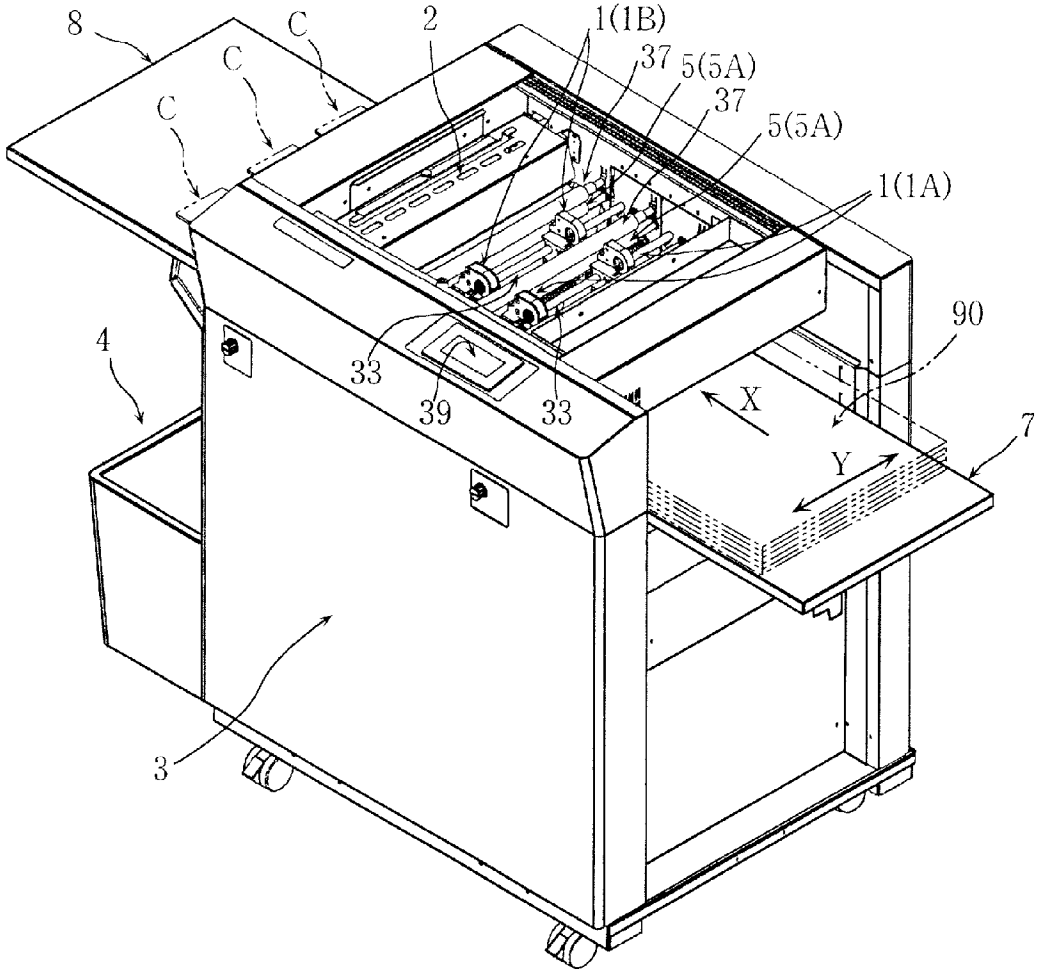
FIG. 1 is a perspective view showing an embodiment of an automatic card-cutting apparatus according to the present invention.

An automatic card-cutting apparatus relating to the present invention is provided with a feeding table 7 on which sheets of paper 90 shown with two-dot broken lines in FIG. 1 are layered and placed, plural transfer rollers 5 to contact the lower face of the paper 90 and transfer the paper 90 sheet by sheet, plural presser rollers 37 touching the upper face of the paper 90 to prevent the transferred paper 90 from floating, plural slitter heads 1 to cut the paper 90 in a transferring direction X, and an outlet table on which cards C, formed by divisional cutting of the paper 90 and shown with two-dot broken lines, are stored, on a main body casing 3. And, an upward-opening dust box 4 is provided outside of the main body casing 3.

Figure 2:
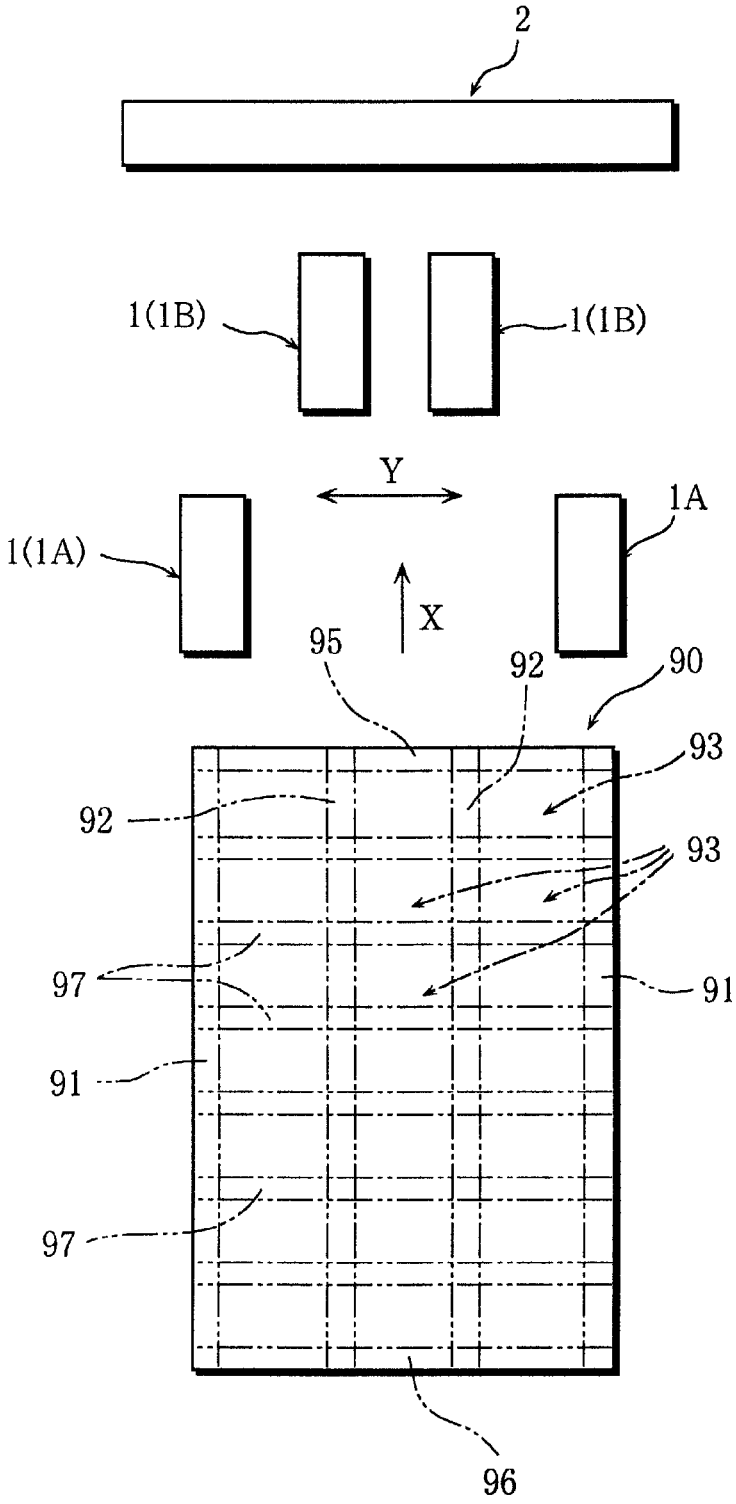
FIG. 2 is a simplified top view showing an example of a slitter head and cutting lay-out.

An example of cutting layout of the paper 90 is hereby shown in FIG. 2 to make the explanation easy. The paper 90, as divided by two-dot broken lines, has plural card-allotted portions 93 to be cards C, left and right side edge portions 91 to be cut, a front edge portion 95 and a rear edge portion 96 to be cut, plural longitudinal middle waste portions 92 to be cut, and plural lateral middle waste portions 97 to be cut. The cutting layout is multi-face layout in which plural cards C are formed with one sheet of the paper 90. For example, size of the card-allotted portion 93 (card C to be formed) is various as post cards, photographs, desk calendar sheets, business cards, etc.

The longitudinal middle waste portion 92 is a middle position in the lateral direction Y of the paper 90 and between card-allotted portions 93 neighboring in the lateral direction Y, and called blank portion or gutter.

The lateral middle waste portion 97 is a middle position in the transferring direction X of the paper 90 and between card-allotted portions 93 neighboring in the transferring direction X, and called blank portion or gutter.

Figure 3:
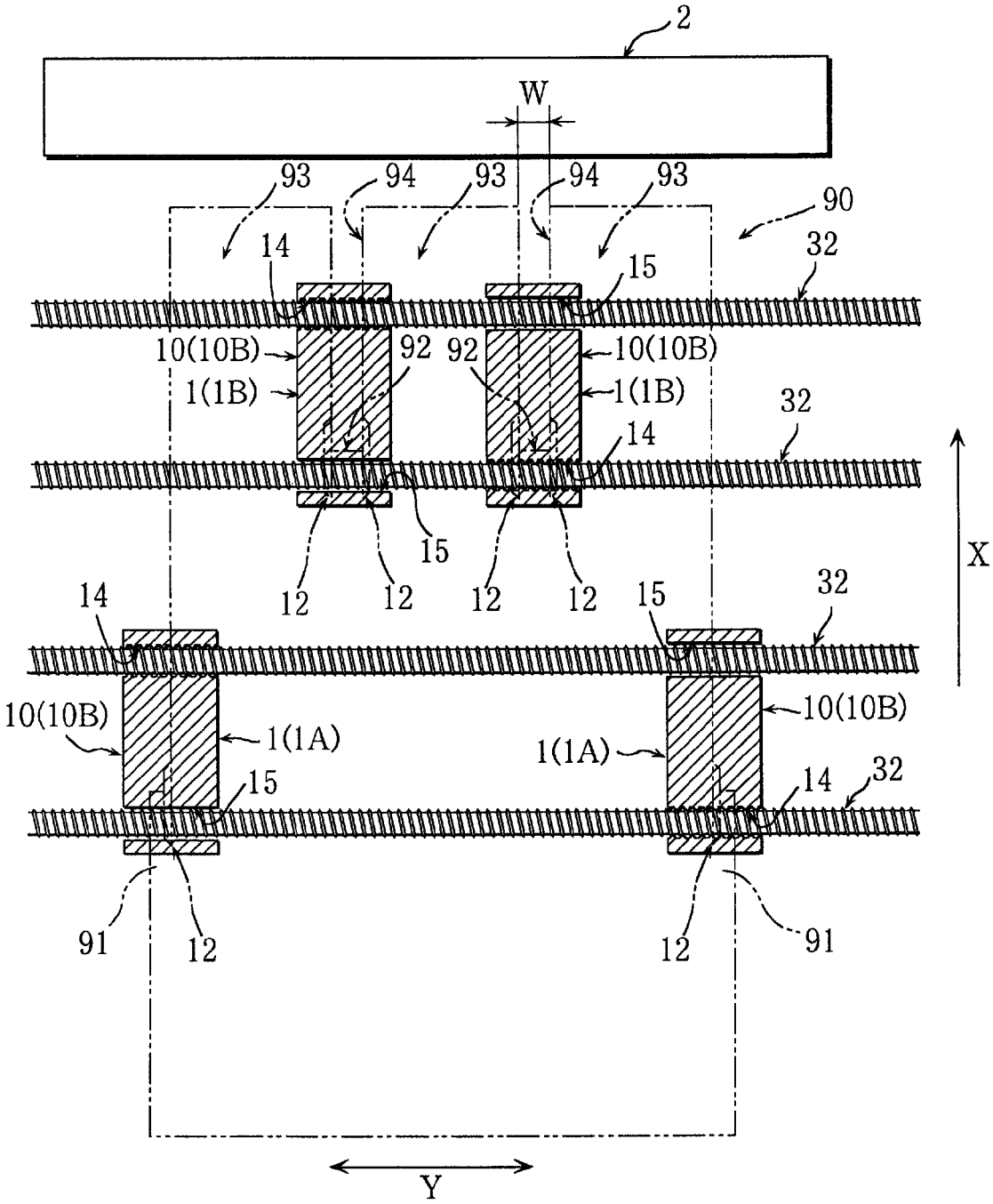
FIG. 3 is a simplified top view showing an example of a slitter head and cutting lay-out with a partial cross section.

In FIG. 3, the plural slitter heads 1 are provided with a pair of left and right side heads 1A to cut the left and right side edge portions 91 shown with two-dot broken lines into belt-shaped, and plural middle heads 1B to cut the longitudinal middle waste portion 92 of the paper 90 into belt-shaped.

Figure 4:
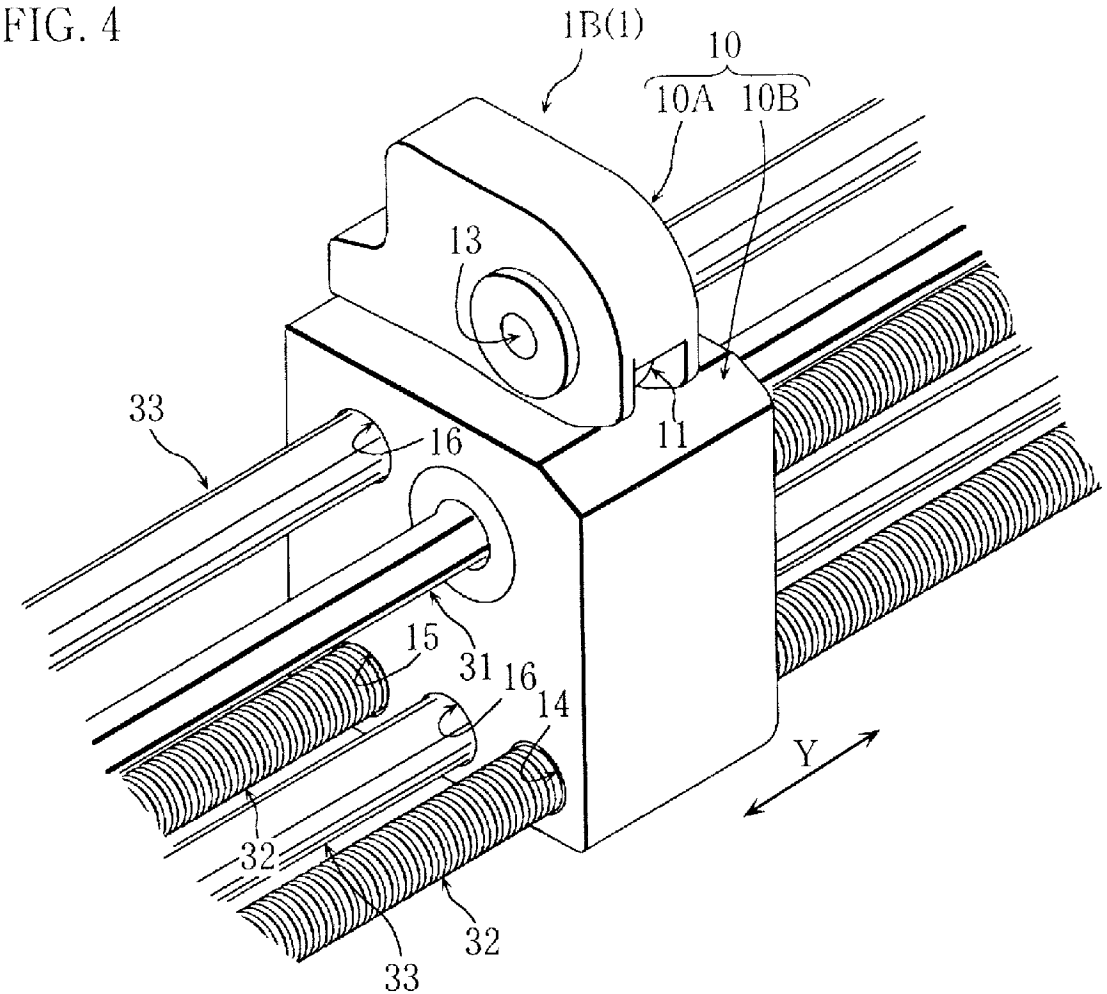
FIG. 4 is a perspective view of a principal portion.
Figure 5:
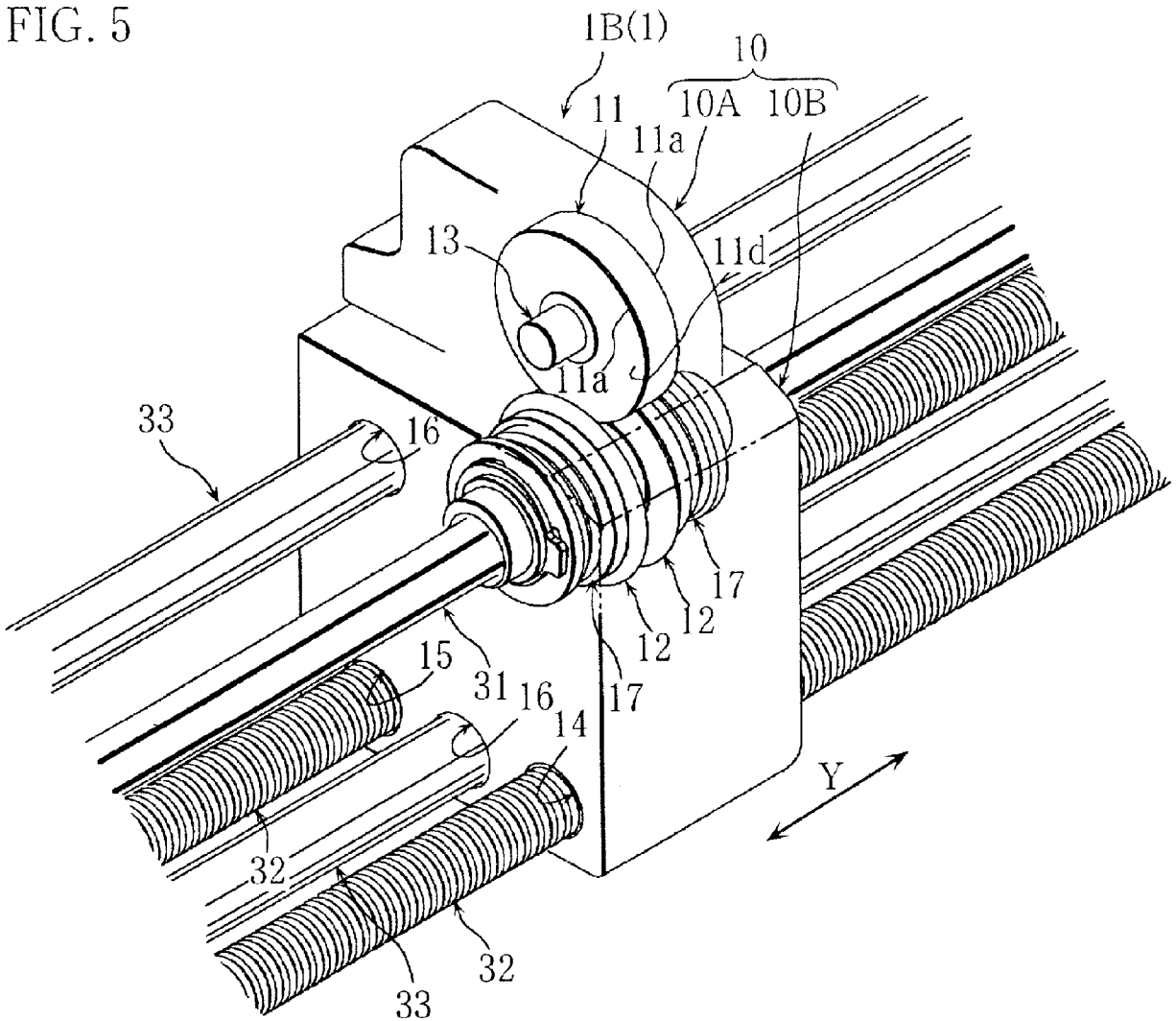
FIG. 5 is a partial transparent view of FIG. 4.
Figure 6:
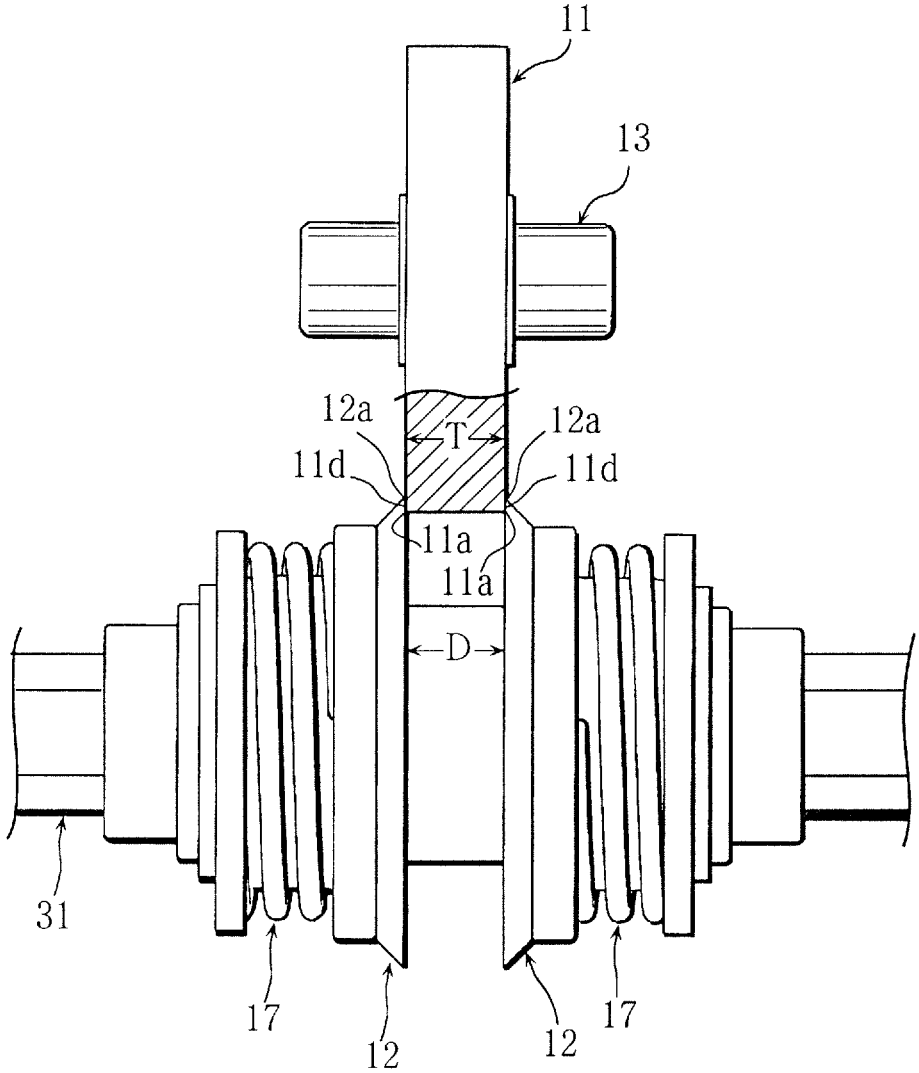
FIG. 6 is an enlarged front view of a principal portion showing an example of an upper blade and a lower blade.

As shown in FIGS. 4 through 6, the middle head 1B has a short shaft 13 supported by an upper case body 10A of a head casing 10. An upper blade 11 is attached to the short shaft as to freely idle. The upper blade 11 is formed into a circular plate and double-blade type in which a corner portion, where the left and right side faces and a peripheral face contact, is formed into a right angle edge (blade) portion 11*a*.

And, the middle head 1B has a pair of left and right lower blades 12, each of which contacts left and right side edge portions 11*d* of the upper blade 11, on a lower case body 10B of the head casing 10

The lower blade 12 is formed into a truncated cone in front view thinner than the upper blade 11, and single-blade type in which a peripheral edge 12*a* disposed on an inner position of the casing 10 is formed into an edge blade.

And, the middle head 1B has a pair of left and right elastic pushing members 17 to elastically push the edges 12*a* of the two lower blades 12 respectively toward the left and right side edge portions 11*d* of the upper blade 11 within the lower case body 10B. The elastic pushing member is composed of a spiral spring, and attached as to be mounted to a rotational force transmitting shaft 31 of polygonal stick inserted to the lower case body 10B as to freely slide in the lateral direction Y.

The lower blade 12 is attached as to be mounted to the rotational force transmitting shaft 31 of polygonal stick inserted to the lower case body 10B as to freely slide in the lateral direction Y and to be driven to rotate.

Then, the middle head 1B is composed as that the pair of left and right lower blades 12 rotates together with the upper blade 11 by frictional force on the contact portions generated by the lower blades 12 holding and pushing the upper blade 11. The rotational force transmitting shaft 31 for the lower blade 12 is mounted on the main body casing 3 on a position under the transferred paper 90.

And, an interval dimension D between the two lower blades 12 (refer to FIG. 6) is kept by the elastic pushing member 17 as to be approximately same as the thickness of the upper blade 11 to cut and remove the longitudinal middle waste portion 92 with a predetermined width dimension W (refer to FIG. 3). And, the width dimension W can be changed by changing the thickness dimension T of the upper blade 11. And, the interval dimension D is set to be 3 to 15 mm, more preferably, 5 to 8 mm. When the interval dimension D is lower than the minimum value, smooth position adjustment becomes difficult when printing deviation exists. When the interval dimension D is over the maximum value, waste is so much that many cards C can't be obtained from one sheet of the paper 90.

The upper blade 11, in other words, may be a thick double blade of short cylinder thicker than the lower blade 12. The lower blade 12, in other words, may be a thin piece blade thinner than the upper blade 11.

And, although not shown in Figures, a fixation portion where the upper case body 10A and the lower case body 10B are mutually fixed is disposed on a position corresponding to a longitudinal slit portion 94 (refer to FIG. 3) of the paper 90 formed with removal of the longitudinal middle waste portion 92 because the paper 90 goes between the upper case body 10A and the lower case body 10B. That is to say, the position of the fixation portion in the lateral direction Y is between the lower blades 12, and the position of the fixation portion in the transferring direction X is a downstream position (forward position) to the upper blade 11.

Next, as shown in FIG. 3, the side head 1A has one lower blade 12 of single-blade type within the head casing 10. And, although not shown in Figures, the side head 1A, similar to the middle head 1B, has one upper blade attached to a short shaft supported by the head casing 10 as to freely idle. And, an elastic pushing member composed of spiral spring is provided to push the lower blade 12 as to contact one of the left and right side edge portions of the upper blade within the casing 10. And, the lower blade 12 of the side head 1A is mounted to a rotational force transmitting shaft inserted to the casing 10 and driven to rotate together with the upper blade by frictional force on the contact portion with the upper blade. In other words, the construction of the cutting portion of the side head 1A is the construction of the middle head 1B from which one of the left and right lower blades 12 and one of the elastic pushing members 17 are omitted. The upper blade of the side head 1A may be the same as that of the middle head 1B or the same as the lower blade 12.

As shown in FIG. 2 and FIG. 3, two side heads 1A and two middle heads 1B are provided. And, the two side heads 1A and the two middle heads 1B are disposed on different positions in the transferring direction X. Further, two middle heads 1B are disposed on the same position in the transferring direction X, and two side heads 1A are disposed on the same position in the transferring direction X.

And, the two side heads 1A and the two middle heads 1B are position-adjustable in the lateral direction Y respectively and independently.

Concretely, as shown in FIG. 3, a nut portion 14 is formed through each of the slitter heads 1 (occasionally called head 1 below) to screw a screw shaft 32 into the lower case body 10B of the casing 10.

And, an escape hole 15 is formed through the lower case body 10B of each of the heads 1 to insert the screw shaft 32 screwing to the neighboring head 1.

In the heads 1 neighboring in the lateral direction, the nut portion 14 of one of the heads 1 and the nut portion 14 of the other of the heads 1 are formed on different positions in the transferring direction X. And, in the heads 1 neighboring in the lateral direction, the escape hole 15 of one of the heads 1 and the escape hole 15 of the other of the heads 1 are formed on different positions in the transferring direction X. That is to say, the neighboring heads 1 mutually differentiate the positions of the nut portions 14 and the escape holes 15. And, the screw shaft 32 is mounted on the main body casing 3 on a position under the transferred paper 90.

One of the heads 1 can be freely moved in the lateral direction Y by the rotation of one of the screw shafts 32 because one of the screw shafts 32 is inserted to one of the heads 1 with screwing and inserted to the other of the heads 1 without screwing.

Each of the plural screw shafts 32 is provided with a motor to move each of the heads 1 in the lateral direction Y independently. That is to say, the heads 1 neighboring in the lateral direction Y can mutually come close to and part from.

And, a controlling portion, for driving the motor for the screw shaft 32 by electric signals to rotate the screw shaft 32, and adjust the position of the head 1 in the lateral direction Y, is provided. The position of each of the heads 1 is adjusted by automatic control of the controlling portion with reading of identification marks such as bar codes printed on the paper 90 by a sensor, or preliminarily input settings.

And, as shown in FIG. 4 and FIG. 5, two guide receiving holes 16 are formed through the lower case body 10B of each of the heads 1 to which two guiding shafts 33 are respectively inserted. The head 1 is set to freely slide in the lateral direction Y with the posture stably kept by the two guiding shafts 33 and the screwed screw shaft 32.

And, the guide receiving holes 16 are formed through the neighboring heads 1 on the same position in the transferring direction X as the neighboring heads 1 share the two guiding shafts 33. The guiding shaft 33 is mounted on the main body casing 3 on a position under the transferred paper 90.

Figure 7:
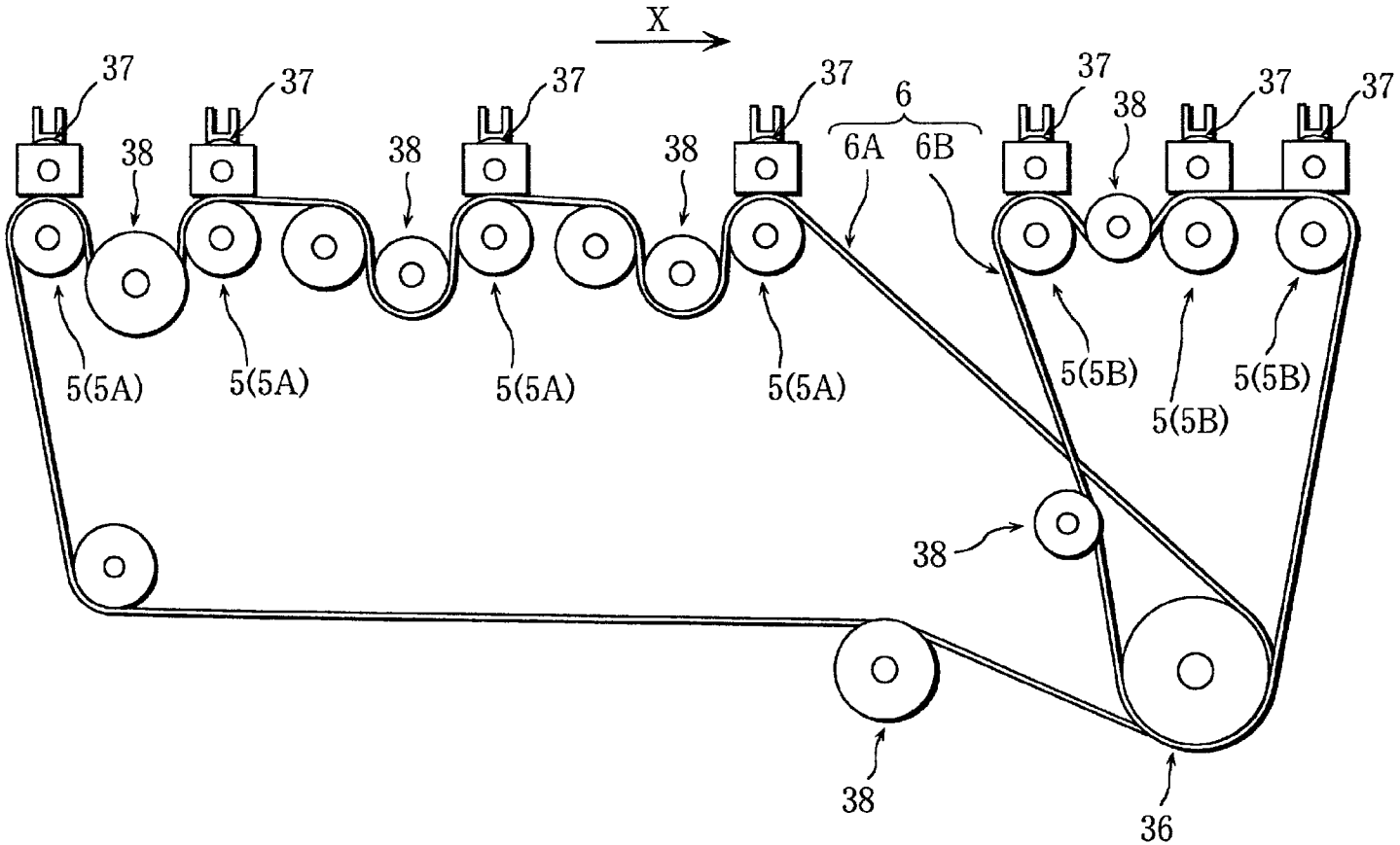
FIG. 7 is a cross-sectional side view showing an example of a timing belt and a transfer roller.

Next, a timing belt 6 to transmit the rotational force to the plural transfer rollers 5 is provided within the main body casing 3 as shown in FIG. 7.

The timing belt 6 is suspended on a driving rotational body 36 composed of a timing pulley driven to rotate by a stepping motor, and also suspended on a receiving timing pulley portion disposed on an end portion of the transfer roller 5. And, tension is given to the timing belt 6 by plural tension pulleys.

The plural transfer rollers 5 are provided with plural slitter side transfer rollers 5A (slitter side transfer rollers 5A group) disposed near the plural slitter heads 1, and positioning transfer rollers 5B (positioning transfer rollers 5B group) disposed near the lateral cutter portion 2 to position the paper 90 when the paper 90 is cut in the lateral direction Y.

Then, the timing belt 6 is divided into a first timing belt 6A to transmit the rotational force from the driving rotational body 36 to the slitter side transfer rollers 5A and a second timing belt 6B to transmit the rotational force from the driving rotational body 36 to the positioning transfer rollers 5B.

The driving rotational body 36 is disposed nearer to the positioning transfer rollers 5B group than to the slitter side transfer rollers 5A group to make the circumference of the second timing belt 6B shorter than the circumference of the first timing belt 6A as to reduce slip and extension for highly accurate transmission more to the positioning transfer rollers 5B group than to the slitter side transfer rollers 5A group without delay of rotation and stop of the driving rotational body 36.

And, a detection sensor for positioning to read the front end portion of the paper 90 is disposed near the upper and lower cutter blades of the lateral cutter portion and on the upstream side (rear side) to the upper and lower cutter blades in the transferring direction X.

And, a controlling portion to control the transfer amount of the paper 90 by rotating the positioning transfer rollers 5B group by driving and stopping the stepping motor according to the signals of the detection sensor and preliminarily input settings is provided.

The feeding table 7 is disposed as to move in perpendicular directions, and a controlling portion to control the movement in perpendicular directions of the feeding table 7 is provided on the main body casing 3.

The paper 90 in layered state can be certainly transferred sheet by sheet to prevent double transfer and entanglement. And, in comparison with a case in which sorting members such as separators are used, user's labor is reduced because position adjustment and changing work of the sorting members as to correspond to the thickness of the paper 90 are unnecessary.

And, waste cut and removed by the head 1 is sent to a shooter on a position under the transfer rollers 5 and stored in the dust box 4. The dust box 4 is not stored within the main body casing 3, accumulating degree of the waste is clear, and the waste can be easily dumped.

And, the main body casing 3 is provided with a touch panel type indication and operation portion 39 in which an operation portion and an indication portion (monitor) are unitedly formed to improve operationality. And, various modifications such as indication switching of operation state and sequence, language indication switching, visual image and indication buttons, indication order, controlling portion program change are easy, and indications easy to understand for operators and visually excellent are made possible thereby.

In the present invention, modifiable and not restricted to the embodiment shown in Figures, one middle head 1B or equal to or more than 3 middle heads 1B may be provided. And, each of the heads 1, not restricted to the automatic control of the controlling portion with reading of identification marks such as bar codes printed on the paper 90 by a sensor or preliminarily made settings, may be adjusted to a desired position manually with operation of the indication and operation portion 39. And, the screw shaft 32 may be manually driven for position adjustment. And, the lateral cutter portion 2, sufficient when the lateral cutting is possible, may be a cutter portion in which an upper cutter blade of belt plate and a lower cutter blade of belt plate are pivoted like scissors and oscillated in up and down directions to cut the paper 90 in the lateral direction Y, or a guillotine type cutter portion in which the edges of the upper and lower cutter blades come close to and part from in horizontal state. And, the size of the paper 90 is freely chosen.

In the present invention, the upstream side or the feeding side of the transferring direction X is called rear side, and the downstream side or the outlet side is called front side. And, the upstream and downstream directions of the transferring direction X are called longitudinal or front and rear directions, the lateral direction Y is called left and right directions, and the thickness direction of the transferred paper 90 is called up and down directions.

Next, the function of the automatic card-cutting apparatus of the present invention is described.

Figures 8A, 8B, 8C:
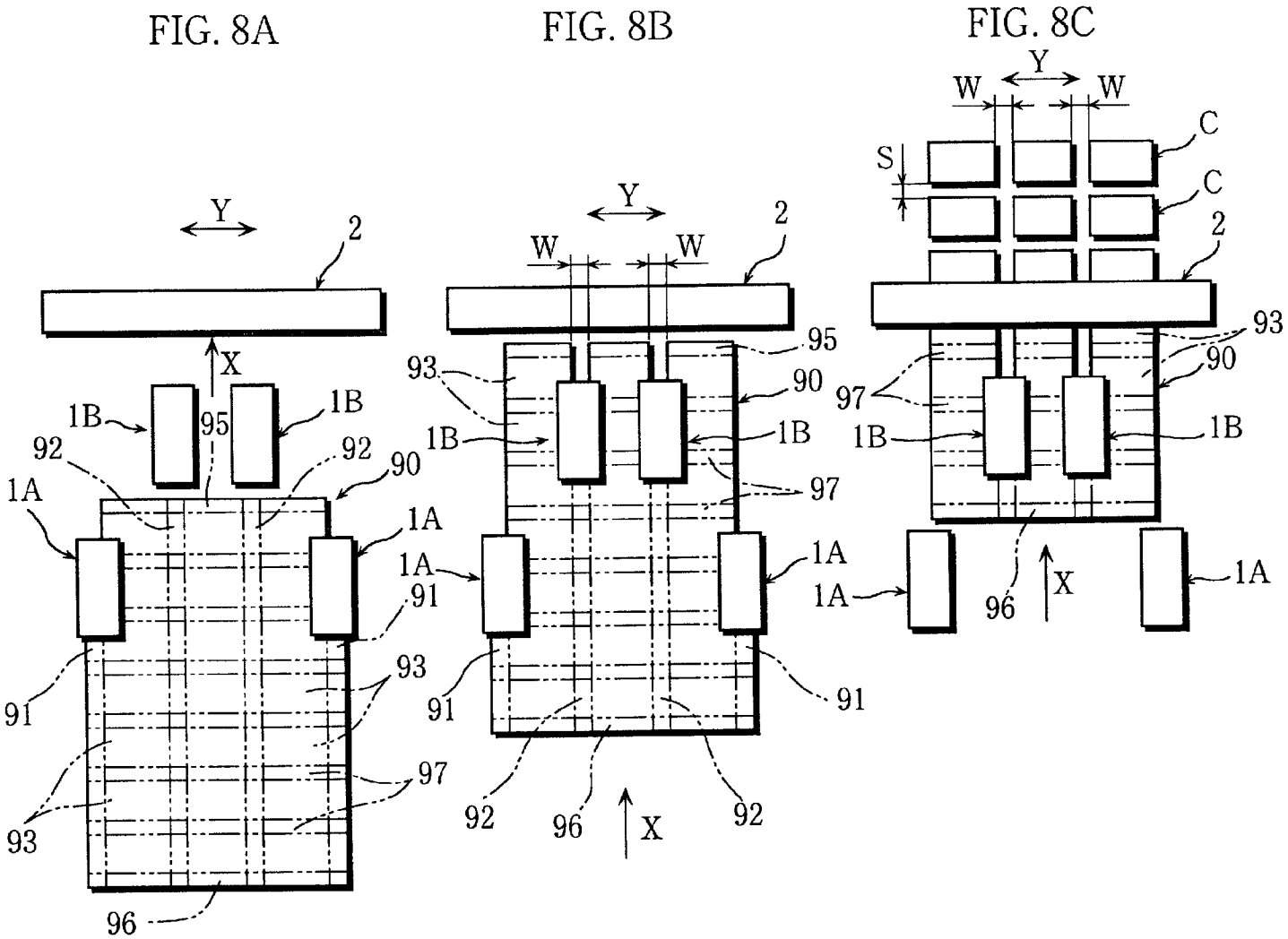
FIG. 8A is a simplified top view to explain functions.
FIG. 8B is a simplified top view to explain functions.
FIG. 8C is a simplified top view to explain functions.
Figure 9:
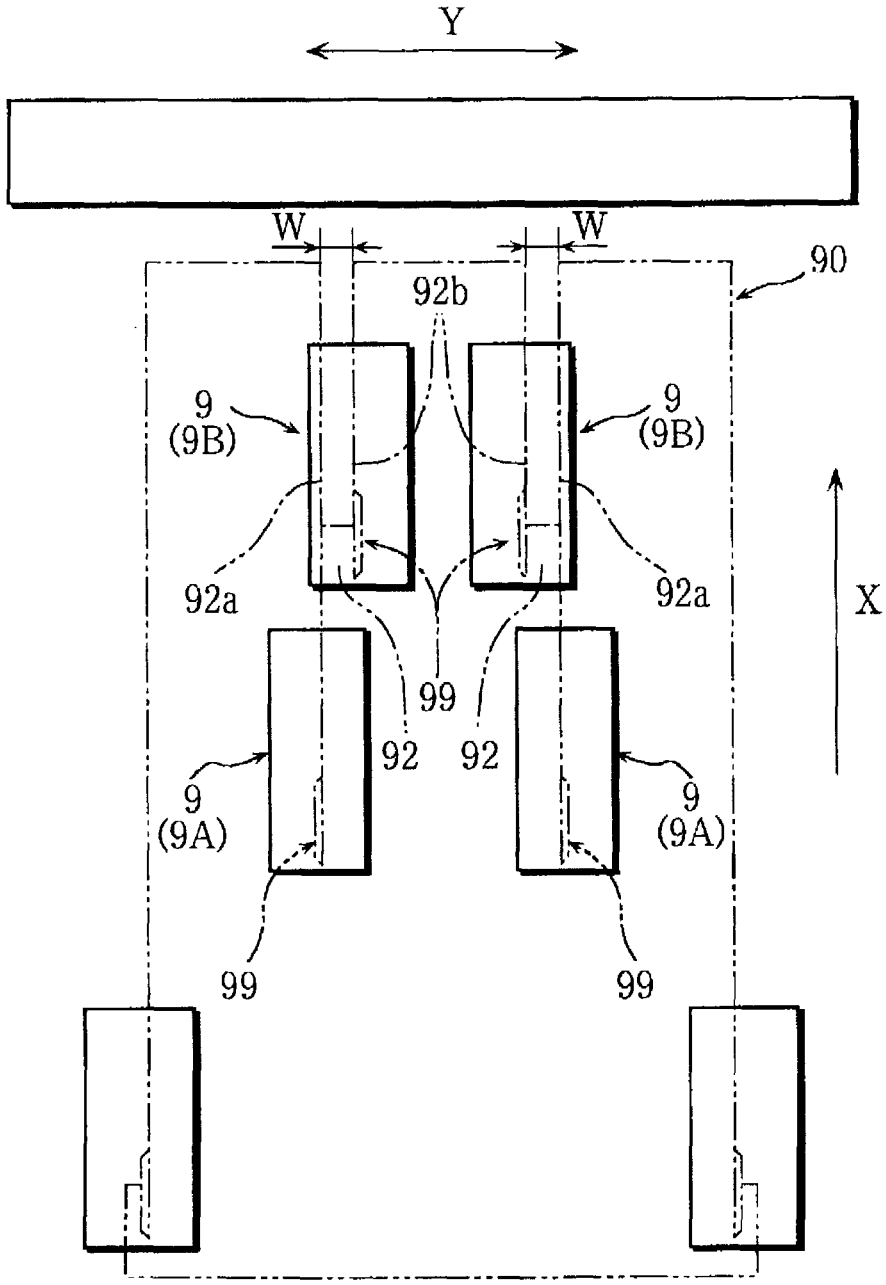
FIG. 9 is an explanatory top view to explain a conventional automatic cutting apparatus.

When the paper 90 is sent in the transferring direction X as shown in FIG. 8A, left and right side edge portions 91 are respectively cut into longitudinal belts by the pair of the left and right side heads 1A.

Then, as shown in FIG. 8B, the paper 90 is sent further, two longitudinal middle waste portions 92 are respectively cut into longitudinal belts by the pair of the left and right middle heads 1B. The longitudinal middle waste portions 92 are cut and removed with a predetermined width dimension W. As described above, cutting force is loaded uniformly on the paper 90 to reduce stick and entanglement of the paper 90 because the longitudinal middle waste portions 92 on plural positions (two positions) are simultaneously cut and removed on the same position in the transferring direction X.

When the paper 90 is sent further, the front end position of the paper 90 is detected by the detecting sensor near the lateral cutter portion 2, the paper 90 is positioned in the transferring direction X by the plural positioning transfer rollers 5B and sent to the lateral cutter portion 2.

Then, the front edge portion 95 is cut off by the lateral cutter portion 2 on a predetermined position in the transferring direction X of the paper 90. After this, sending and stop of the paper 90 are repeated by the positioning transfer rollers 5 with high accuracy, the paper 90 is intermittently transferred, and the lateral cutter portion 2 cuts the paper 90 corresponding to the sending and stop.

And, as shown in FIG. 8C, lateral middle waste portions 97 are cut and removed with a predetermined width dimension S. Finally, the rear edge portion 96 is cut off and divisional cutting of one sheet of the paper 90 ends, and plural cards C, cut into predetermined lateral and longitudinal dimensions, are obtained from one sheet of the paper 90.

As described above, number of the slitter heads can be reduced, production of the apparatus can be made easy to reduce the cost, and the apparatus can be made compact with small longitudinal dimension because in the automatic card-cutting apparatus of the present invention, provided with the plural transfer rollers 5 to transfer the paper 90, the plural slitter heads 1 to cut the paper 90 in the transferring direction X, and the lateral cutter portion 2 to cut the paper 90 in the lateral direction Y at right angles with the transferring direction X to conduct divisional cutting of the paper 90 into plural cards C, each of the plural slitter heads 1 is provided with the side head 1A disposed as to be freely position-adjusted in the lateral direction to cut the side edge portion 91 of the paper 90 into belt shape, and the middle head 1B having the upper blade 11 of disc and the pair of lower blades 12 each of which contacts each of left and right side edge portions 11*d* of the upper blade 11, disposed as to be freely position-adjusted in the lateral direction to cut the longitudinal middle waste portion 92 of the paper 90 into belt shape. The longitudinal middle waste portion 92 can be cut and removed by the predetermined width dimension W with high accuracy. That is to say, the cards C of predetermined dimensions can be certainly obtained from one sheet of the paper 90. The slitter head 1 can be moved in the lateral direction (Y) keeping the positional relationship between the upper blade 11 and the lower blade and the positional relationship between the left and right lower blades, accurate positioning work is unnecessary, and the apparatus can easily and swiftly correspond to various cutting layout and printing deviation.

And, the entire apparatus can be made compact further, the cards C cut with highly accurate longitudinal and lateral dimensions can be obtained from one sheet of paper further in large amount because the side head 1A and the middle head 1B are disposed on different positions in the transferring direction X, plural middle heads 1B are provided, and the plural middle heads 1B are disposed on the same position in the transferring direction X.

A long driving rotation shaft for the upper blade, mounted on the main body casing 3 on a position above the transferred paper 90, is unnecessary, and a large space can be obtained above the paper 90 because the upper blade 11 is having the right angle edge portion 11*a*, attached to the short shaft 13 supported by the casing 10 of the middle head 1B as to freely idle, and rotated together with the lower blades 12 by frictional force of contact portion with the rotationally driven lower blades 12. Therefore, disposal of jamming dust generated by entanglement of the paper 90, and maintenance and repairing of the apparatus can be conducted easily and swiftly.

The paper 90 can be positioned with high accuracy because the timing belt 6 to transmit rotational force of the driving rotational body 36 to the plural transfer rollers 5, the timing belt 6 is divided into the first timing belt 6A to transmit the rotational force to the slitter side transfer rollers 5A disposed near the slitter heads 1, and the second timing belt 6B to transmit the rotational force to the positioning transfer rollers 5B disposed near the lateral cutter portion 2 to conduct positioning when the paper 90 is cut in the lateral direction Y. And, the paper 90 can be pitch-sent with high accuracy, and the front edge portion 95, the rear edge portion 96, and the lateral middle waste portion 97 can be cut and removed with the predetermined dimensions. That is to say, the cards C of the predetermined dimensions can be certainly obtained from one sheet of the paper 90.

While preferred embodiments of the present invention have been described in this specification, it is to be understood that the invention is illustrative and not restrictive, because various changes are possible within the spirit and indispensable features.

What is claimed is:

1. An automatic card-cutting apparatus provided with plural transfer rollers to transfer paper, plural slitter heads to cut the paper in a transferring direction, and a lateral cutter portion to cut the paper in a lateral direction at right angles with the transferring direction to conduct divisional cutting of the paper into plural cards comprising a construction in which:

each of the plural slitter heads is provided with a side head disposed as to be freely position-adjusted in the lateral direction to cut a. side edge portion of the paper into belt shape, and a middle head having elastic pushing members, an upper blade of disc and a pair of lower blades each of which contacts each of left and right side edge portions of the upper blade, disposed as to be freely position-adjusted in the lateral direction by the elastic pushing members to cut a longitudinal middle waste portion of the paper into belt shape.

2. The automatic card-cutting apparatus as set forth in claim 1, wherein the side head and the middle head are disposed on different positions in the transferring direction, plural middle heads are provided, and the plural middle heads are disposed on the same position in the transferring direction.

3. The automatic card-cutting apparatus as set forth in claim 1, wherein the upper blade is having a right angle edge portion, attached to a short shaft supported by a casing of the middle head as to freely idle, and rotated together with the lower blades by frictional force of contact portion with the rotationally driven lower blades.

4. The automatic card-cutting apparatus as set forth in claim 1, Wherein a timing belt to transmit rotational force of a driving rotational body to the plural transfer rollers is provided; and the timing belt is divided into a first timing belt to transmit the rotational force to slitter side transfer rollers disposed near the slitter heads, and a second timing belt to transmit the rotational force to positioning transfer rollers disposed near the lateral cutter portion to conduct positioning when the paper is cut in the lateral direction.

5. The automatic card-cutting apparatus as set forth in claim 2, wherein a timing belt to transmit rotational force of a driving rotational body to the plural transfer rollers is provided; and the timing belt is divided into a first timing belt to transmit the rotational force to slitter side transfer rollers disposed near the slitter heads, and a second timing belt to transmit the rotational force to positioning transfer rollers disposed near the lateral cutter portion to conduct positioning when the paper is cut in the lateral direction.

6. The automatic card-cutting apparatus as set forth in claim 3, wherein a timing belt to transmit rotational force of a driving rotational body to the plural transfer rollers is provided; and the timing belt is divided into a first timing belt to transmit the rotational force to slitter side transfer rollers disposed near the slitter heads, and a second timing belt to transmit the rotational force to positioning transfer rollers disposed near the lateral cutter portion to conduct positioning when the paper is cut in the lateral direction.

* * * * *